US008365476B2

(12) United States Patent
Richard et al.

(10) Patent No.: US 8,365,476 B2
(45) Date of Patent: Feb. 5, 2013

(54) BRACED FRAME FORCE DISTRIBUTION CONNECTION

(75) Inventors: Ralph M. Richard, Tucson, AZ (US); Rudolph E. Radau, Jr., Tucson, AZ (US); James E. Partridge, Pasadena, CA (US); Clayton J. Allen, Peoria, AZ (US)

(73) Assignee: Seismic Structural Design Associates, Inc., Los Angeles, CA (US)

( * ) Notice: Subject to any disclaimer, the term of this patent is extended or adjusted under 35 U.S.C. 154(b) by 561 days.

(21) Appl. No.: 12/342,493

(22) Filed: Dec. 23, 2008

(65) Prior Publication Data

US 2009/0165419 A1 Jul. 2, 2009

Related U.S. Application Data

(60) Provisional application No. 61/006,188, filed on Dec. 28, 2007.

(51) Int. Cl.
*E04B 1/98* (2006.01)

(52) U.S. Cl. ..... 52/167.1; 52/167.3; 52/656.9

(58) Field of Classification Search ..... 52/652.1, 52/656.9, 167.1, 167.3, 167.4
See application file for complete search history.

(56) References Cited

U.S. PATENT DOCUMENTS 4,409,765 A * 10/1983 Pall ..... 52/167.1
4,441,289 A * 4/1984 Ikuo et al. ..... 52/167.1
5,680,738 A 10/1997 Allen et al.
6,022,165 A * 2/2000 Lin ..... 403/231
6,237,303 B1 5/2001 Allen et al.
6,516,583 B1 * 2/2003 Houghton ..... 52/655.1
6,591,573 B2 * 7/2003 Houghton ..... 52/656.9
6,993,880 B2 * 2/2006 Cameron et al. ..... 52/653.2
7,047,695 B2 5/2006 Allen et al.
7,076,926 B2 * 7/2006 Kasai et al. ..... 52/167.8
7,225,588 B2 * 6/2007 Nakamura et al. ..... 52/167.3
7,784,226 B2 * 8/2010 Ichikawa et al. ..... 52/167.1
2003/0009977 A1 * 1/2003 Houghton ..... 52/656.9

OTHER PUBLICATIONS

Tsai, K.C., Yuan-Tao Weng, Min-Lang Lin, Chui-Hsin Chen, Juin-Wei Lai, and Po-Chien Hsiao (2003), "Pseudo Dynamic Tests of a Full-Scale CFT/BRB Composite Frame: Displacement Based Seismic Design and Response Evaluations, "Proceedings of the Joint NCREE/JRC Workshop on International Collaboration on Earthquake Mitigation Research, Tapei, Taiwan.

Gross, J. L., 1990, Experimental Study of Gusseted Connections, Engineering Journal, vol. 27, No. 3, American Institute of Steel Construction, Chicago, IL. , pp. 89-97.

Lopez, W.A., Gwie,D.S., Saunders, C.M., and Lauck, T.W., 2002, "Lessons Learned from Large-Scale Tests of Unbonded Braced Frame Subassemblies", Proceedings of the Structural Engineers Association of California 2002 Convention, pp. 171-183.

Lopez, W.A., Gwie, D.S. Saunders, C.M., and Lauck, T.W., 2004, "Structural Design and Experimental Verification of a Buckling-Restrained Braced Frame System", Engineering Journal, vol. 41, No. 4, ,American Institute of Steel Construction, Chicago, IL. , pp. 177-186.

(Continued)

*Primary Examiner* — William Gilbert
*Assistant Examiner* — Alp Akbasli

(57) ABSTRACT

A structural framework that includes a column, a beam, a brace beam coupled at an angle to the column and the beam, and a gusset plate to connect the brace beam with the column and the beam. The framework also includes a shear plate with horizontally slotted holes to couple to the column to the beam. The structural framework may also include double framing angles or a flex plate coupled to the gusset plate and to the beam via spacer plates to provide for a semi-rigid connection.

7 Claims, 14 Drawing Sheets

OTHER PUBLICATIONS

Roeder, C.W., and Lehman, D.E., 2004, "Braced Frame Gusset Connections for Seismic Design", Proceedings of the Structural Engineers Association of California 2004 Convention, pp. 501-505.

Walters, M.T., Maxwell, B.H., and Berkowitz, R.A., 2004, "Design for Improved Performance of Buckling-Restrained Braced Frames", Proceedings of the Structural Engineers Association of California 2004 Convention, pp. 507-513.

Richard, Ralph M., Ph.D., .E., "Braced-Frame Steel Structures 402 When and Why Frame Action Matters", Structural Engineer, Apr. 2009, pp. 20-21 and pp. 24-25.

Richard, R.M. (1986), "Analysis of Large Bracing Connection Designs for Heavy Construction", National Steel Construction Conference Proceedings, American Institute of Steel Construction, Chicago, IL., pp. 31.1-31.24.

* cited by examiner

BRACED FRAME FORCE DISTRIBUTION CONNECTION

CROSS-REFERENCE TO RELATED APPLICATION

This application claims the benefit of provisional patent application No. 61/006,188, filed on Dec. 28, 2007, which is incorporated herein by reference.

FIELD OF THE INVENTION

Embodiments of the present invention relate broadly to a method of construction and design of members of load bearing and braced frames and their connections to enhance and provide for high resistance and ductile behavior of the frames when subjected to loading such as gravity, seismic, and wind loading. More specifically, embodiments of the present invention relate to the design and construction of structural frame members and their connections that use gusset plates to join the beams and columns to the lateral load carrying frame brace members. Embodiments of the present invention may be used, but not necessarily exclusively used, in steel frame buildings, in new construction as well as modification of existing structures.

BACKGROUND OF THE INVENTION

In the construction of modern structures such as buildings and bridges, braced frames including beams, columns, and frame braces are arranged and fastened or joined together, using known engineering principles and practices to form a skeletal load resisting framework of the structure. The arrangement of the beams, also known as girders, columns, and braces and their connections are designed to ensure the framework can support the gravity and lateral loads contemplated for the intended use of the bridge, building or other structure. Making appropriate engineering assessments of loads and how these loads are resisted represents current design methodology. These assessments are compounded in complexity when considering loads for wind and seismic events, and determining the forces, stresses, and strains. It is well known that during an earthquake, the dynamic horizontal and vertical inertia loads and stresses and strains imposed on a structure have the greatest impact on the connections of the beams, columns, and braces which constitute the seismic damage resistant frame. Under high seismic or wind loading or even from repeated exposure to milder loadings, the connections in the structure may fail, possibly resulting in the collapse of the structure and the loss of life.

The beams and columns are typically, but not limited to, conventional rolled or built up steel I-beams, also known as W sections or wide flange sections, or box sections also known as tube sections. The frame brace members may have similar shapes as the beams and columns but may also be single or double angles or channels or tubular or tee shaped members. The beams, columns and braces are usually joined using what is known in the structural engineering profession as gusset plates. The presence of these gusset plates, which may be typically either bolted or welded to the joined members, causes the structure members to be rigidly joined so that the structural frame becomes, in essence, a braced-moment frame which results in unintentional overloading of the frame members (Richard 1986). Results of full scale tests conducted by Tsai et al. (2003), Lopez et al (2002, 2004), Gross (1990), and Roeder et al. (2004) demonstrate that stiff beam-column-brace connections attract large force and moment demands, which can lead to high moments and shears in the beams and columns. These unintentional high moments and shears in the joined members of the braced frame can result in premature fracture modes of the structural members when the frame is subjected to the design gravity, seismic, and wind loadings because these forces are not considered in the frame design. Evaluation of the full scale tests by Walters et al (2004) have shown that in conventionally designed braced frames, the moment frame action caused by the unintentional and undesirable beam and column moments and shears alone will provide a large part of the braced frame's resistance to lateral loads.

As previously stated, in conventionally braced frame designs, moment frame action caused by the gusset plates result in unintentional and undesirable moments and shears in the beams and columns. This can lead to fractures in the beam and column flanges and/or webs when the frame is subjected to lateral seismic or wind loading. Conventionally braced frame designs resist lateral load in a combination of braced frame action and moment frame action.

In the current practice of braced frame design, the beam-to-column connection at the brace gusset is normally a rigid welded and/or bolted assembly to the beam and column which creates a stiff moment resisting connection that generates moments and shears in the braced frame that are not accounted for in the braced frame design rationale. Both analytical studies and full scale tests have demonstrated the drift or displacement related joint rotation can result in the following potentially serious structural effects on the components of the braced frame: (1) a pinching or an in-plane crushing effect of the gusset plate which can lead to the buckling of the gusset plate; (2) overload of the welds and/or bolts of the gusset plate connections to the beam and column caused by the buckling of the gusset plate; (3) yielding and/or fracture of the beam and column flanges and/or webs due to high moments and shears in these components due to moment frame action that is not accounted for in conventional braced frame design rationale; and (4) unintended moment frame action that resists a large portion of the braced frame lateral loads rather than braces. This moment frame action is typically not accounted for in the design of the braced frame so that the force distribution in the braced frame is significantly different than the assumed design forces.

BRIEF DESCRIPTION OF THE DRAWINGS

The object and advantage of the embodiments of the invention will become more readily apparent to those of ordinary skill in the art after reviewing the following detailed description and accompanying documents wherein.

DETAILED DESCRIPTION

Figure 1A:
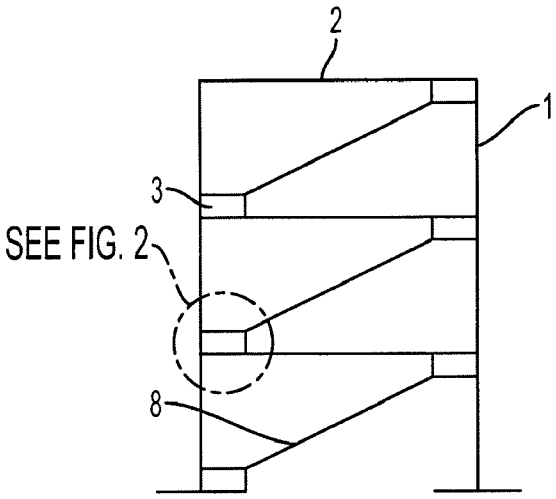
FIG. 1A is an example of a diagonal frame brace structural framework and FIG. 1B shows an example of a chevron frame brace structural framework according to embodiments of the invention.

An embodiment of the present invention provides a new and improved beam-to-column-to-brace connection, which includes a gusset plate, that reduces the bending moments and shears in the beams and columns of conventionally joined braced frames when the structural framework may be subjected to gravity and lateral loads such as those caused by wind and seismic loadings. The improved connection may extend the useful life of new braced framed structures, as well as that of braced frames in existing structures when incorporated into a retrofit modification for existing structures The moments and shears in the beams and columns may be reduced by two ways. First, a flexure mechanism may be provided to transfer the horizontal forces in the gusset plate to the beam. Second, a shear plate may be provided to bolt the beam web to the column flange connection such that the shear plate includes horizontally slotted holes.

The flexure mechanism may include either (1) a beam web slot under the gusset plate that separates the beam flange from the beam web or (2) a flexure plate or double framing angles assembly using spacer plates that transfers the gusset plate forces to the beam flange. These flexure mechanisms essentially may eliminate the pinching frame action that leads to buckling and collapse of the gusset plate. The flexure mechanisms also may reduce the moments and shears in the column.

A shear plate with horizontally slotted holes to connect and bolt the beam web to the column may eliminate the connection moment caused by the horizontal bolt forces in the beam web and the horizontal force in the gusset plate to column connection.

In one embodiment according to the invention, the structural frames resist lateral loads in a truss-like action consistent with braced frame design rationale which differs from conventionally braced frame designs as explained above. Conventionally braced frame designs resist lateral load in a combination of braced frame action and moment frame action.

Embodiments of the invention may reduce the stresses and strains in the joined members caused by moment frame action when the braced frame is subjected to lateral loadings such as wind or seismic events; may reduce or eliminate the undesirable effects of the kinematic end rotation of the brace and thereby improve the performance of the brace in resisting the braced frame lateral load; and/or may limit the forces in the beams and columns of the braced frame to primarily axial forces when the braced frame is subjected to lateral loadings, such as wind or seismic events.

Additional embodiments of the invention may limit the forces in the beams and columns of the braced frame to primarily axial forces to prevent damage to these components when the braced frame is subjected to lateral loadings such as wind or seismic events; may allow for joint rotations in the braced frame which reduces the moments and shears in the members of the braced frame; may either reduce or eliminate the need for beam web stiffeners in the proximity of the gusset plate; and/or may eliminate the need for horizontal and/or vertical stiffeners on the gusset plate.

Embodiments of the invention may prevent damage to the braced frame beams and columns when the braced frame is subjected to seismic loading by keeping the beams and columns essentially elastic and allowing only the braces to be stressed to their yield loads; may reduce the residue displacements in the braced frame after the frame has been subject to seismic forces; may reduce the size of the gusset plates that are required in conventionally designed braced systems; and/or may move the working point in conventionally braced frames from the intersection of the centerlines of the beam and column to the intersection of the beam and column flange thereby reducing the size of the gusset plate.

The embodiments of the invention may reduce the rigidity of the welded and/or bolted gusset plate connection assembly. A reduction in rigidity may eliminate or significantly reduce the moments and shears in the beam, column, and brace when the braced frame is subjected to lateral drift or displacement. Such lateral drift may be due to wind or seismic loading. To this end, the embodiments of the invention may provide for a hinging or flexure mechanism in the beam or in the gusset plate to beam connection.

The effect of the hinging or flexure mechanism may create a large reduction in the beam and column moments which essentially may eliminate the moment frame action in the braced structural frame. The hinging or flexure mechanism may also reduce the moment and shears in the brace and also may allow the gusset plate to rotate with the drift of the frame and thereby may reduce the tendency for the gusset plate to buckle or collapse. Gusset plate buckling may result in the fracture of the gusset plate connection to the beam and/or column. Moreover, the hinging or flexural mechanism may reduce the possibility of unintentional large moments and shears in the columns could result in the development of plastic hinges in the columns of the braced frame.

Embodiments of the invention may also provide for the braces to absorb or dissipate substantial amounts of energy when the frame may be subjected to lateral loads such as seismic and wind loads. The braces, which may react most effectively in a uniaxial state of stress, may provide for efficient use of material thereby achieving a robust structural system. Additionally, the lateral force resisting elements of the braced frame may be economically and expeditiously restored by replacing flexural elements and the braces if damaged by lateral wind or seismic loading.

Figure 1B:
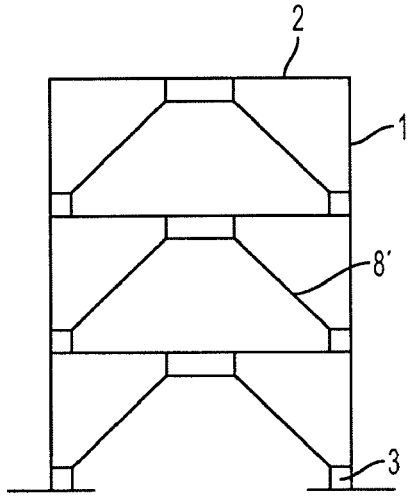

Referring to FIG. 1A and FIG. 1B, there is shown examples of structural assemblies according to the embodiments of the invention. FIG. 1A depicts columns 1, beams 2, and diagonal frame brace members 8 to form the skeletal structural framework. FIG. 1B shows a structural framework that utilizes chevron bracing with frame brace members 8'. Gusset plates 3 create the connection among the columns 1, beams 2, and diagonal frame brace members 8, 8'. The gusset plates of FIG. 1A and FIG. 1B may be connected to the columns 1, beams 2, and frame brace members 8, 8' by conventional techniques such as bolting, welding, pinning, or any combination thereof. Both the diagonal bracing of FIG. 1A and the chevron bracing of FIG. 1B may resist loads such as seismic or wind loads to maintain the structural integrity of the frame.

Figure 2:
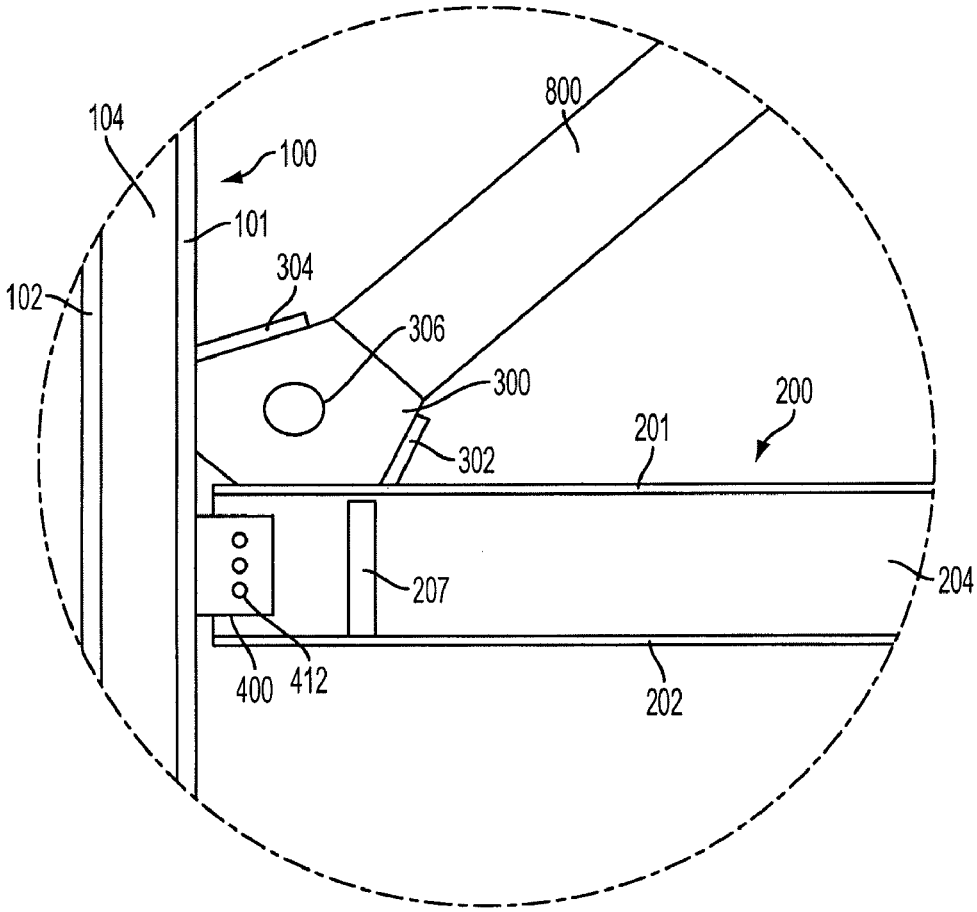
FIG. 2 is a magnified view of a conventional connection amongst the beam, brace, column, and gusset plate connection according to FIG. 1A.

FIG. 2 shows an example of a conventional connection with a column 100, beam 200, brace member 800, and gusset plate 300 connection according to FIG. 1A. The column 100 may include a first column flange 101, a second column flange 102, and a column web 104 between the first column flange 101 and the second column flange 102. An example of a column 100 used in the structural framework may include a wide flange or I beam of 14 inches by 176 pounds per foot [W14×176 (360×262)] column. The beam 200 may include a first beam flange 201, a second beam flange 202, and a beam web 204 between the first beam flange 201 and the second beam flange 202. An example of a beam 200 used in the structural framework may include a wide flange or I beam of 27 inches by 94 pounds per foot [W27×94 (690×140)] beam. A gusset plate 300 may connect the frame brace member 800 to the column 100 and the beam 200. The gusset plate may be provided with a pin hole brace attachment detail 306 to join the frame brace member 800 to the gusset plate 300. Other connections between the gusset plate 300 and the frame brace member 800 may be used such as a bolted detail attachment.

The gusset plate 300 may be coupled to the first column flange 101 of the column 100. The gusset plate 300 and first column flange 101 may be coupled by a weld connection. The gusset plate 300 may be coupled to the first beam flange 201 of the beam 200 by a weld connection. Conventional stiffeners 302, 304 may be welded to the edges of the gusset plate 300 to provide extra strength to the framework. A vertical beam stiffener 207 may be welded to the beam web 204 to provide reinforcement.

The beam 200 may be joined to the column 100 via a shear plate 400. A space L may be provided between the first column flange 201 and the beam web 204. The shear plate 400 may connect to the beam web 204 and to the first column flange 101. The shear plate 400 may be coupled to the first column flange 101 via a shop weld connection. The shear plate may also include round holes 412 to receive bolts to make the connection.

Structural analysis shows that when a structural framework such as the framework depicted in FIG. 2 is subject to certain loads, the angle between the column 100 and the beam 200 tends to close when the force due to the frame brace member 800 is in tension. The decrease in angle may cause the column 100 and beam 200 to crush and buckle the gusset plate 300. The structural action results in undesirable and unintended moment and shear forces in the beam 200 and column 100. Examples of such loads that may cause the angle to decrease are a lateral seismic load or a wind load.

Figure 3A:
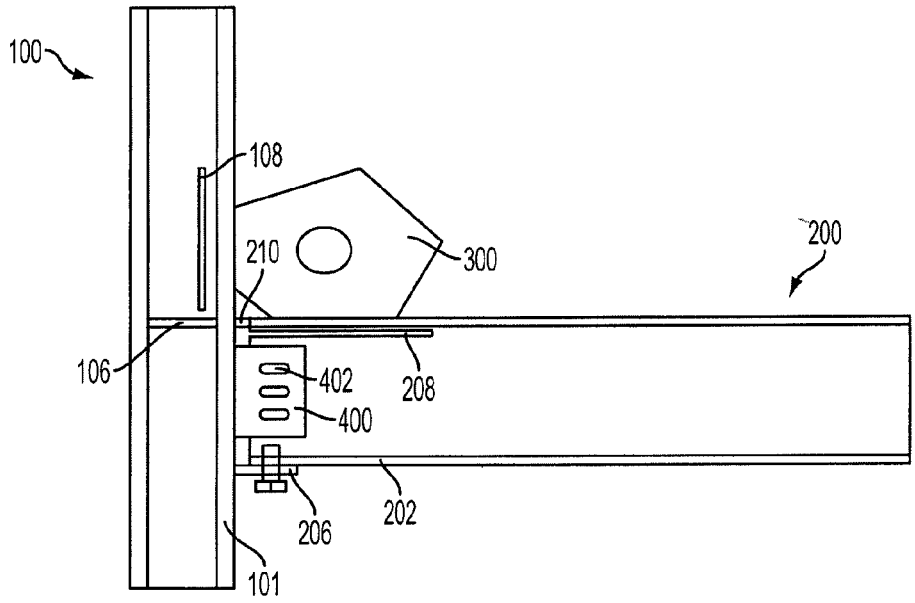
FIG. 3A is a beam, column, and gusset plate connection with a beam web slot and a column web slot according to embodiments of the invention.

FIG. 3A shows another example of a structural framework. The beam 200 may include a beam web slot 208 adjacent to the first beam flange 201. The column 100 may include a column web slot 108 adjacent to the first column flange 101. The slots 108, 208 and additionally long slotted holes 402 of the shear plate 400, may reduce the moment and shear forces in the beam 200 and the column 100 when the structural frame may be subject to lateral forces. In this FIG. 3A, the second beam flange may be stabilized with a stabilization plate 206 that is attached to the beam 200 and the column 100. The first beam flange 201 may be connected to the first column flange 101 via a complete joint penetration (CJP) weld 210.

Figure 3B:
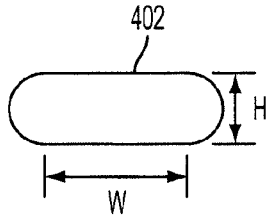
FIG. 3B is a magnified view of a long slotted hole.

FIG. 3B shows a detail of an oblong long slotted hole 402 with a width W and a height H. These holes 402 may be specified by the American Institute of Steel Construction (AISC). The longitudinal direction of the long slotted hole may be twice the dimension as the width. The shear plate 400 may include a long slotted hole 402. The long slotted hole 402 may receive a bolt so that the shear plate 400 may be bolted to the beam web 204.

Figure 4:
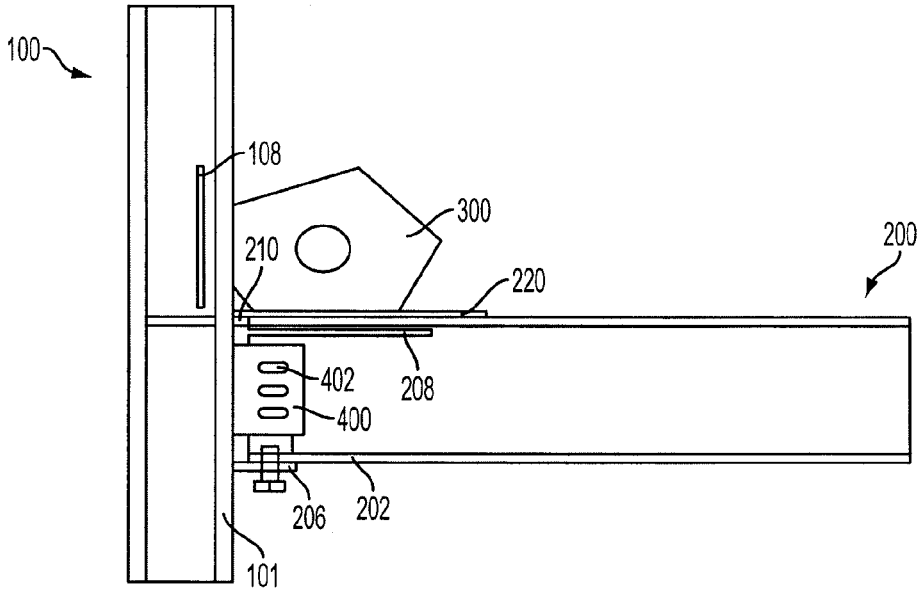
FIG. 4 is a modification of FIG. 3 that uses a reinforcing plate for the gusset plate to beam connection according to embodiments of the invention.

FIG. 4 shows another exemplary embodiment of the invention. An additional reinforcement plate 220 may be attached to the gusset plate 300 and the first beam flange 201 to provide additional connection strength if necessary.

Figure 5:
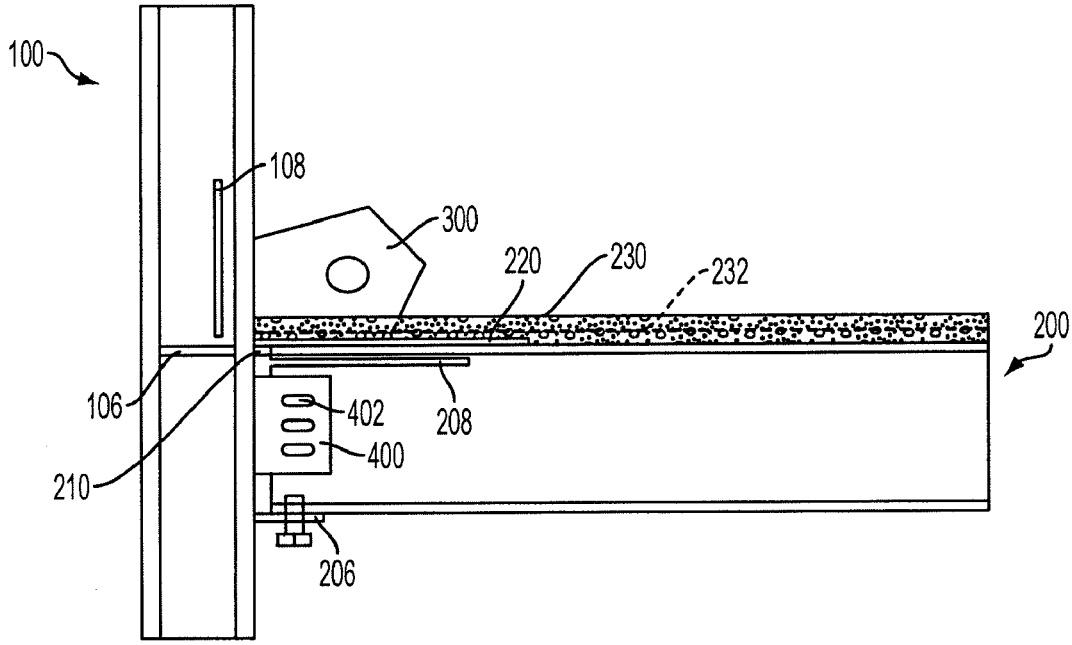
FIG. 5 is a modification of FIG. 3 that uses a reinforced concrete slab for additional connection reinforcement according to embodiments of the invention.

FIG. 5 is a modification of the exemplary embodiment of FIG. 4. A concrete deck 230 with a reinforcement bar 232 may be provided above the stabilization plate 220 to increase the strength of the connection.

Figure 6:
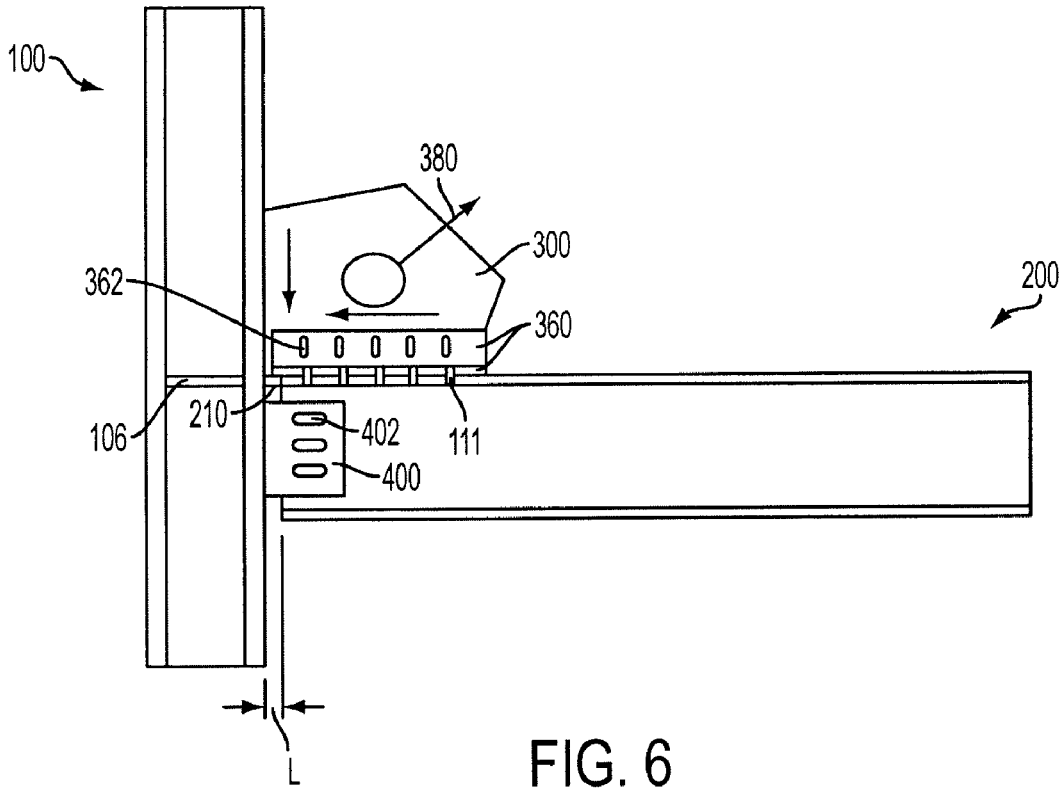
FIG. 6 is a beam, column, and gusset plate connection with double framing angles according to embodiments of the invention.

FIG. 6 shows another exemplary embodiment according to the invention. The gusset plate 300 may be attached to the first beam flange 201 via double framing angles 360. The double framing angles may include long slotted holes 362. The gusset plate 300 may also include the long slotted holes 362 for the attachment. The long slotted holes 362 may receive bolts. The bolts are tightened only snug tight so that when the structural frame may be subject to lateral loads, the bolts slip and reduce the moment and shear forces in the column 100 and the beam 200.

The beam 200 may be connected to the column 100 via a shear plate 400 connection. The beam web 204 may be bolted to the shear plate 400 and the shear plate 400 may be welded to the first column flange 101. The shear plate may have long slotted holes 402 that are able to receive bolts. The bolts may also have a snug tight fit to allow for a semi-rigid connection. The long slotted holes with the snug tight bolts allow the structural frame to have more elasticity and allow the connections to be less rigid than conventional connections. The long slotted holes 402 in the shear plate 400 restrict the bolts to resisting only vertical loads.

Figure 7:
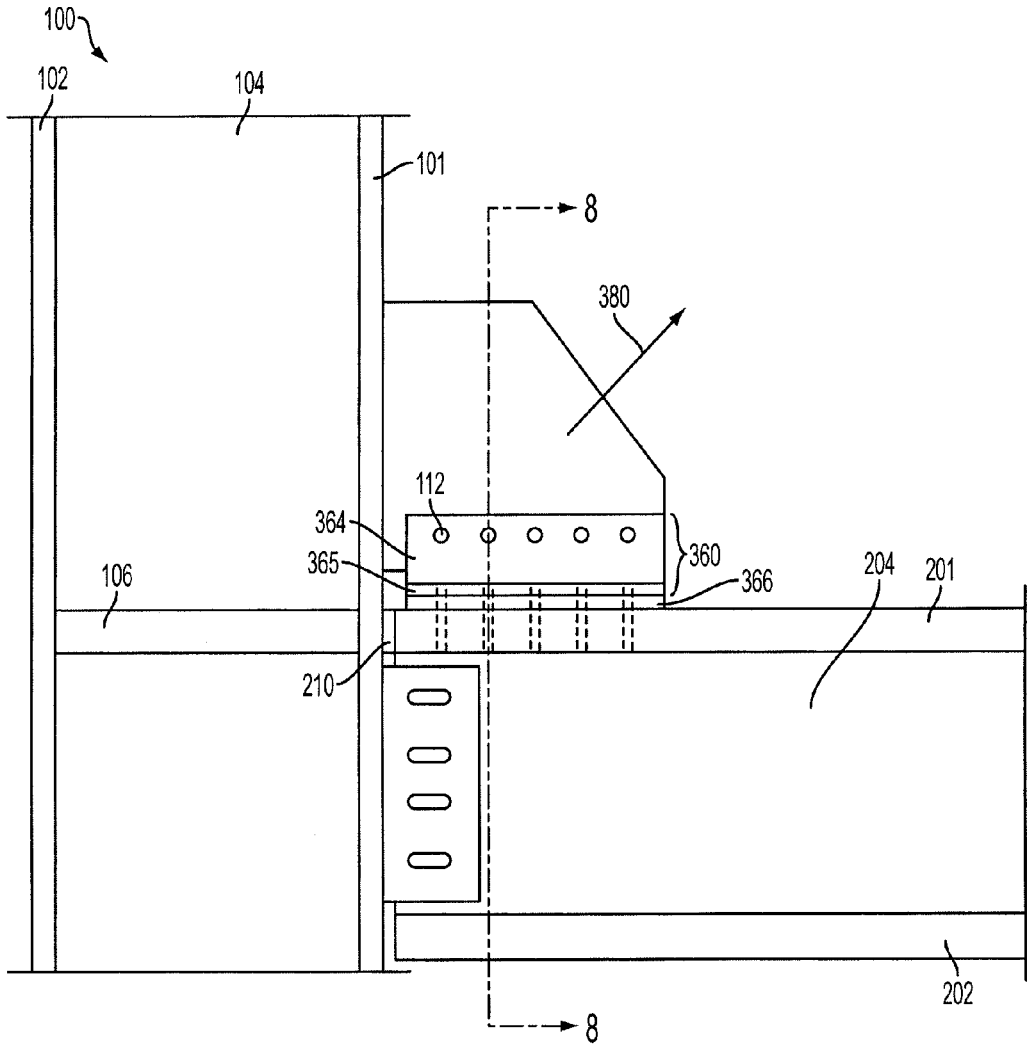
FIG. 7 is a beam, column, and gusset plate connection with double framing angles and spacer plates according to embodiments of the invention.
Figure 8:
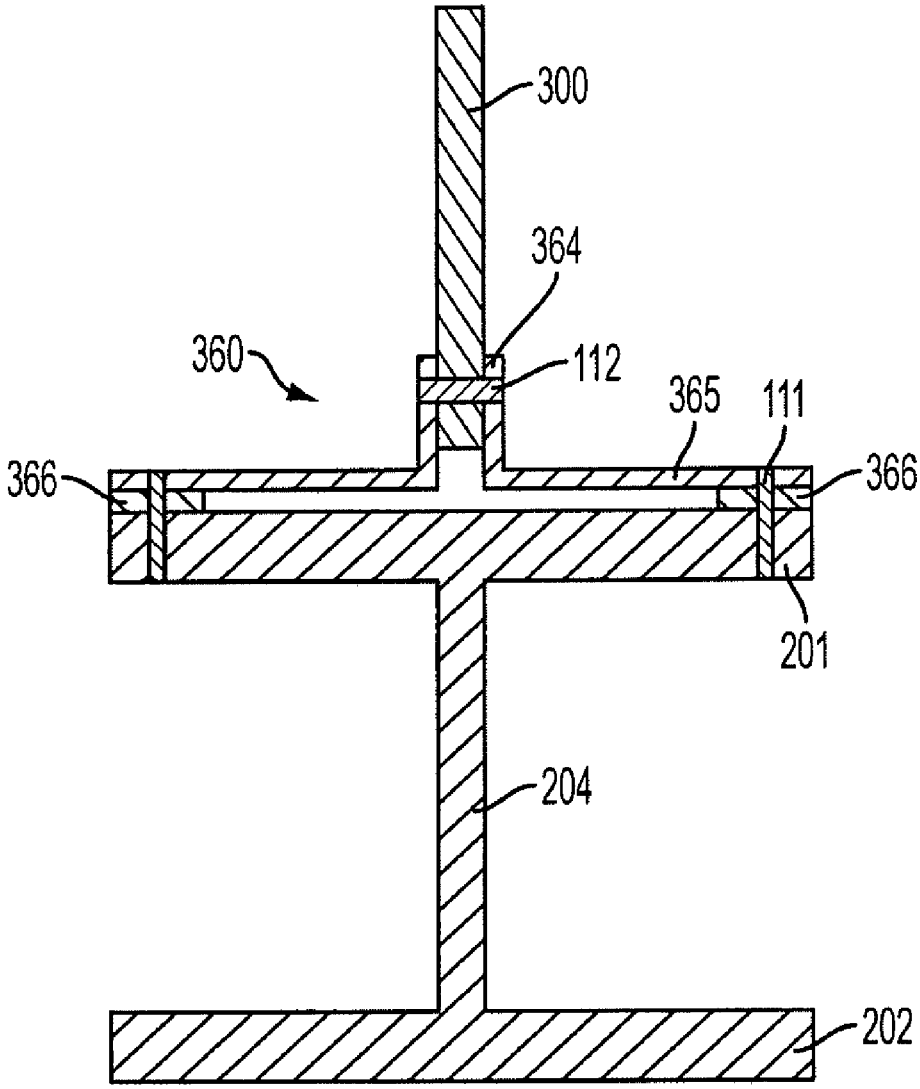
FIG. 8 is a cross-section of FIG. 7 according to embodiments of the invention.

FIGS. 7 and 8 depict a further embodiment according to the invention. In this embodiment, the structural framework is under a compressive force 380 due to the frame brace member 800 (not depicted here). The gusset plate 300 is connected to the beam 200 via double framing angles 360 and spacer plates 366. The double framing angles 360 may include circular holes 112 but may alternatively include long slotted holes. The framing angle 360 may include a vertical plate or leg 364 and a horizontal plate or leg 365. The horizontal plate 365 may rest upon spacer plates 366. The double framing angles 360 may be connected to the first beam flange 201 by bolts 111 via the spacer plates 366.

As depicted in FIG. 8, the thickness of the spacer plates determines the height of a space between the horizontal plate 365 and the first beam flange 201. The spacer plates 366 allow the double framing angles 360 to flex when the structural frame may be subjected to lateral loads. The spacer plates 366 with the double framing angles 360 may reduce the moment and shear forces in the frame by providing a flexible beam to column connection.

As in FIG. 6, FIG. 7 shows that the beam web 204 may be bolted to the shear plate 400. The long slotted holes 402 in the shear plate 400 restrict the bolts to resisting only vertical loads.

Figure 9:
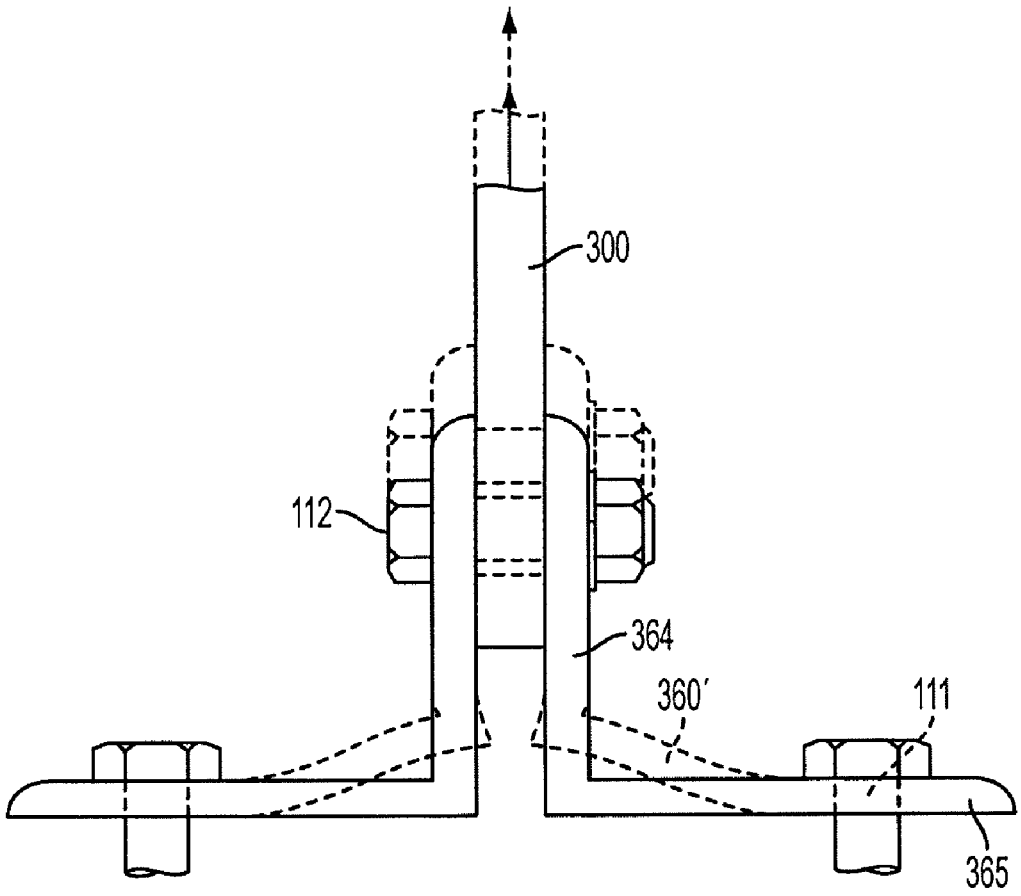
FIG. 9 is a magnified view of the deformation of double framing angles and a gusset plate caused by a load according to embodiments of the invention.

FIG. 9 shows the flexible nature of the double framing angles 360 according to embodiments of the invention. The double framing angles 360 deflect and deform in the manner shown as the dotted lines of 360' when the structural frame may be subject to a load. The deformation 360' may cause the bolts 112 and the gusset plate 300 to likewise deform as shown in the dotted lines of FIG. 9.

Figure 10:
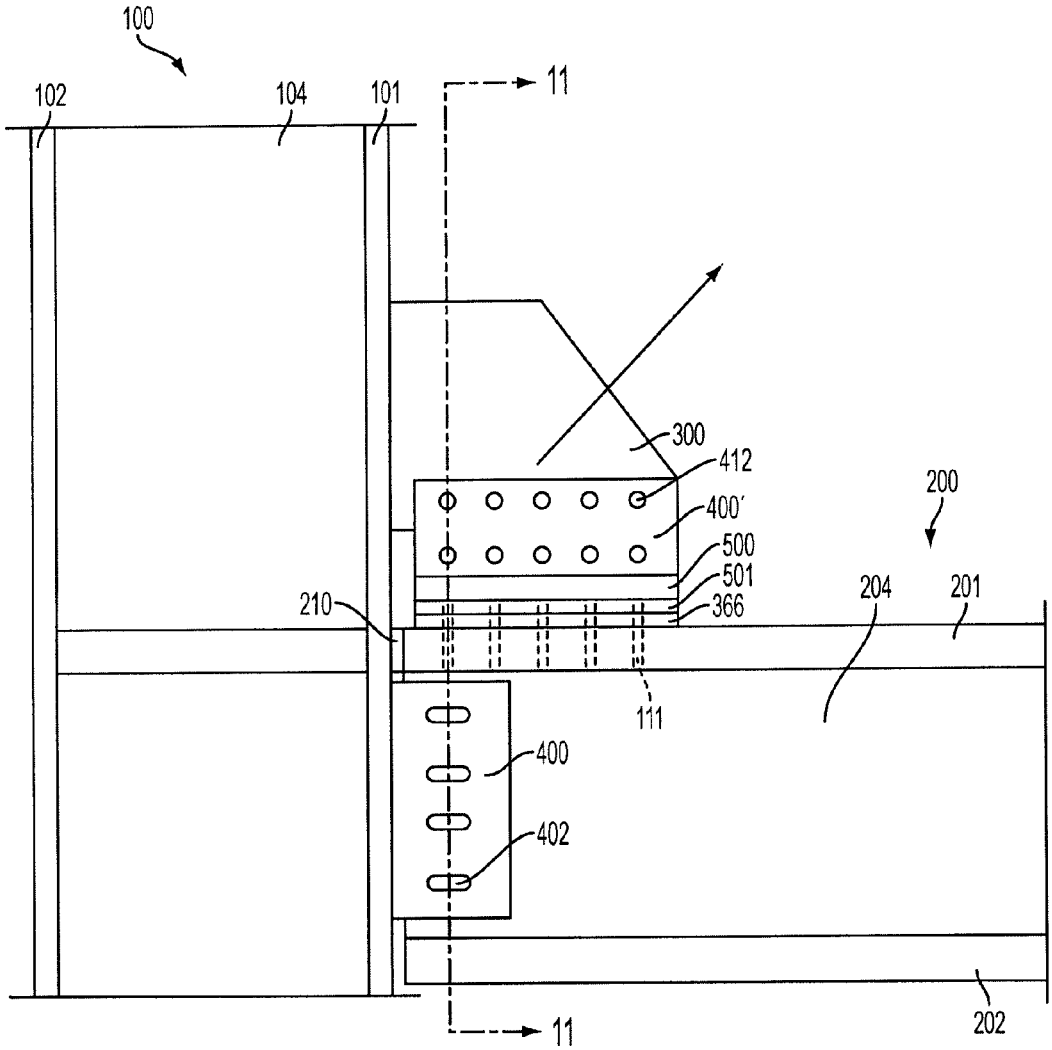
FIG. 10 is a beam, column, and gusset plate as an all-bolted connection according to embodiments of the invention.
Figure 11:
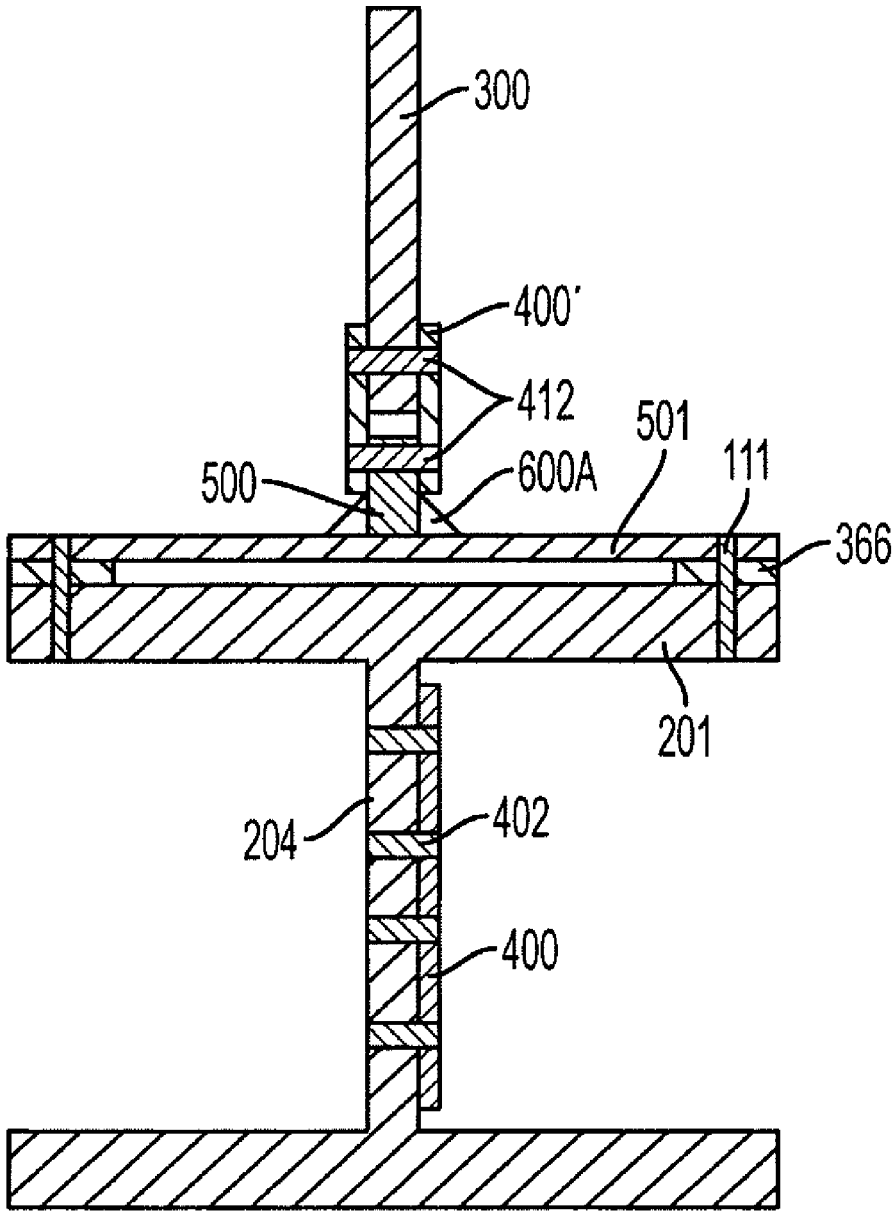
FIG. 11 is a cross-section of FIG. 10 according to embodiments of the invention.

FIGS. 10 and 11 show another exemplary embodiment of the invention. FIG. 11 is a cross-section of FIG. 10 along the dotted lines of FIG. 10. In this embodiment as depicted in FIG. 11, a flex plate 501 may be provided to complete the gusset plate 300 to the beam flange 201 connection. The flex plate 501 may be welded to a vertical plate 500 via welds 600A. The vertical plate 500 may be connected to the gusset plate 300 by a plate 400'. The plate 400' may have one or a plurality of holes 402' to receive bolts to secure the gusset plate 300 to the plate 400'. The flex plate 501 may be connected to the first beam flange 201 by spacer plates 366 and bolts 111. The thickness of the spacer plates 366 may determine the distance the flex plate 500 is elevated from the first beam flange 201. The beam web 204 may be connected to the first column flange 101 by a shear plate 400.

Figure 12:
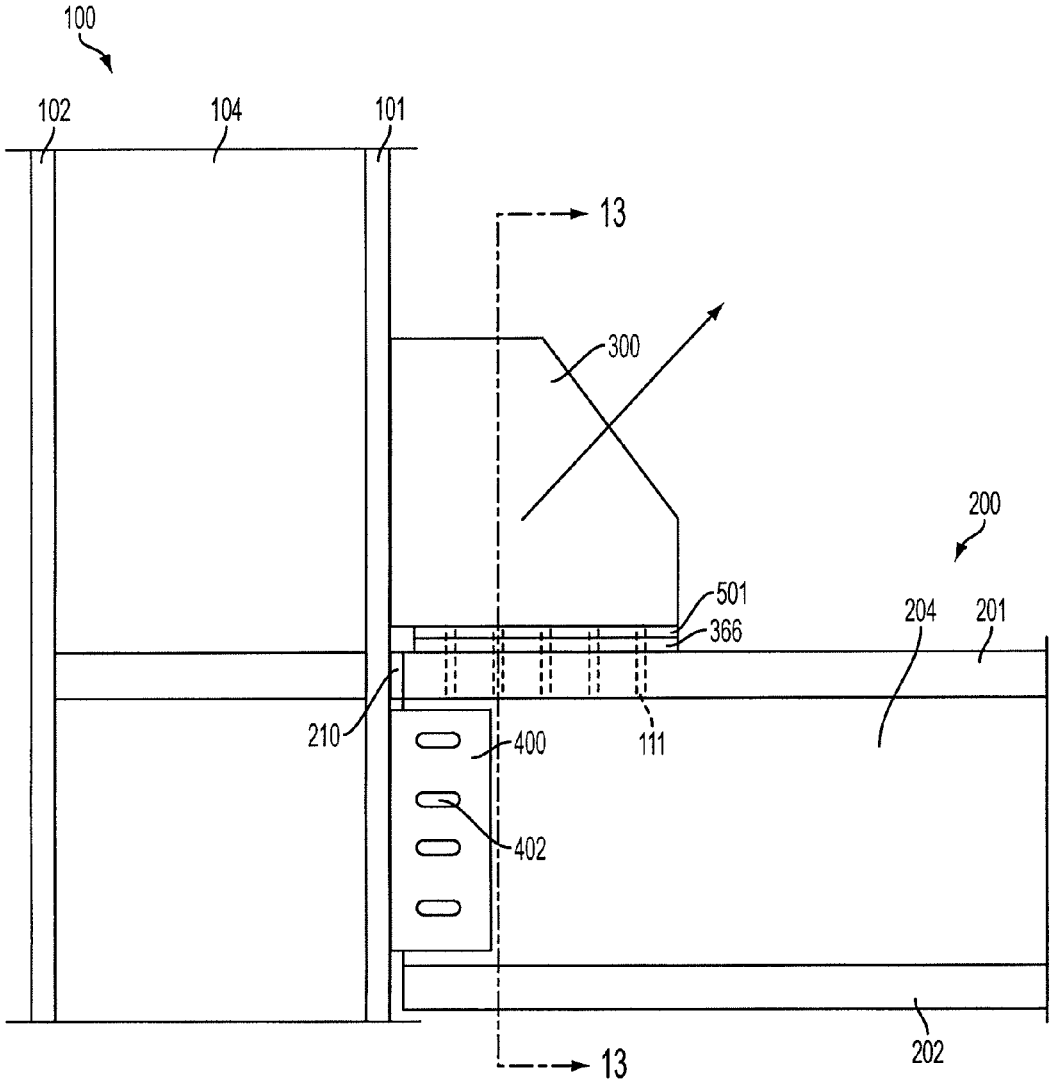
FIG. 12 is a is a beam, column, and gusset plate connection utilizing a flex plate and spacer plate connection according to embodiments of the invention.
Figure 13:
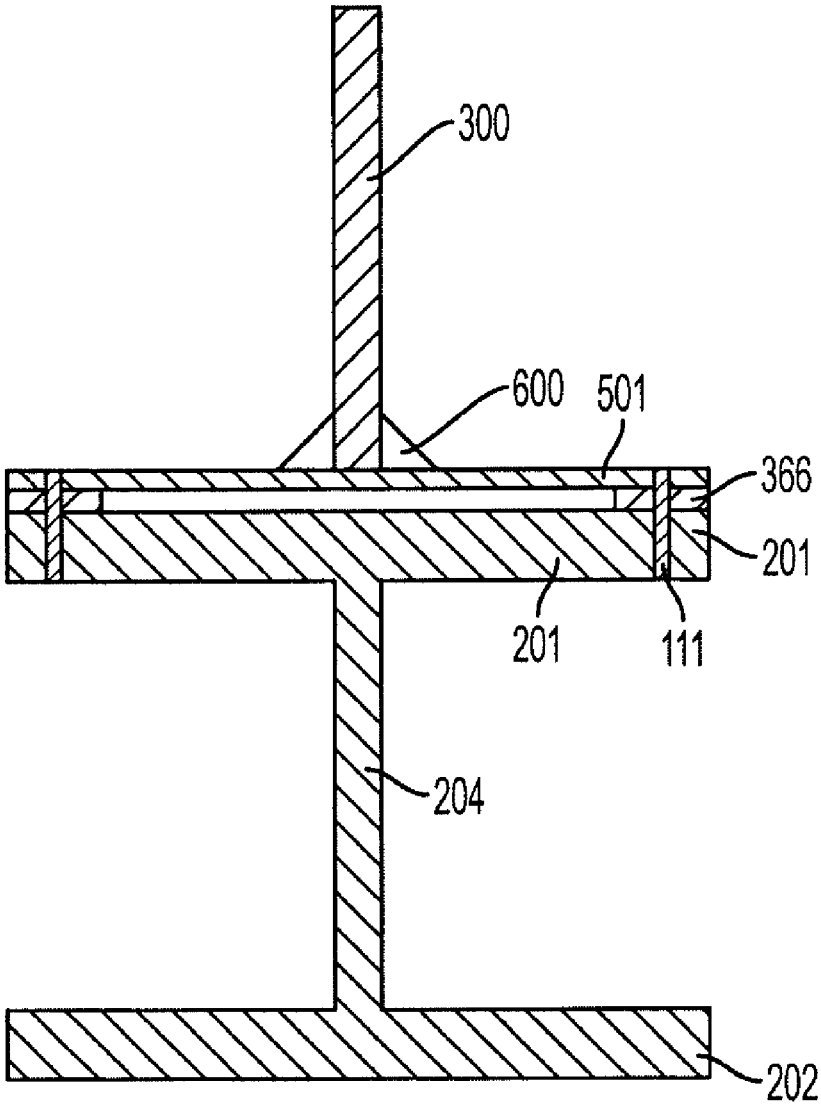
FIG. 13 is a cross-section of FIG. 12 according to embodiments of the invention.

FIGS. 12 and 13 show yet another exemplary embodiment of the invention. FIG. 13 is a cross-section of FIG. 12 at the dotted lines of FIG. 12. In this embodiment, the gusset plate 300 may be welded via a welds 600 to the flex plate 501. Other connections may be possible to connect the gusset plate 300 to the flex plate 501.

Figure 14:
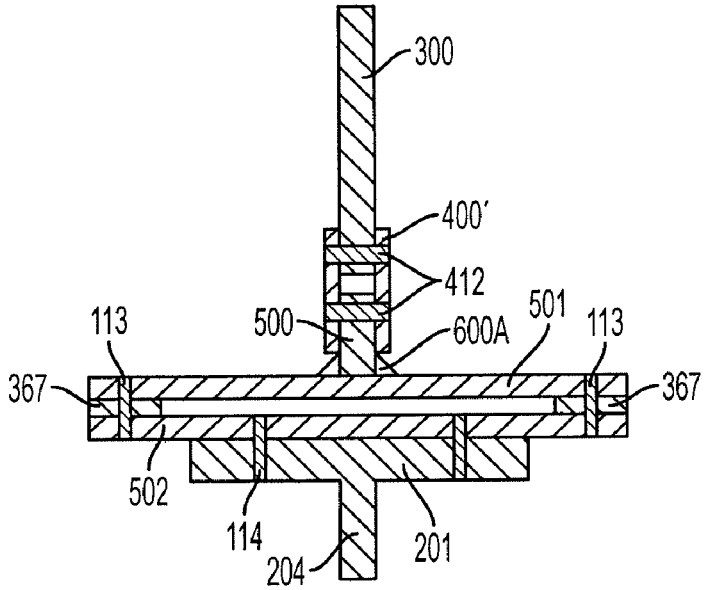
FIG. 14 is a cross-section of a beam, column, and gusset plate connection with a double flex plate and spacer plate bolted connection according to embodiments of the invention.
Figure 15:
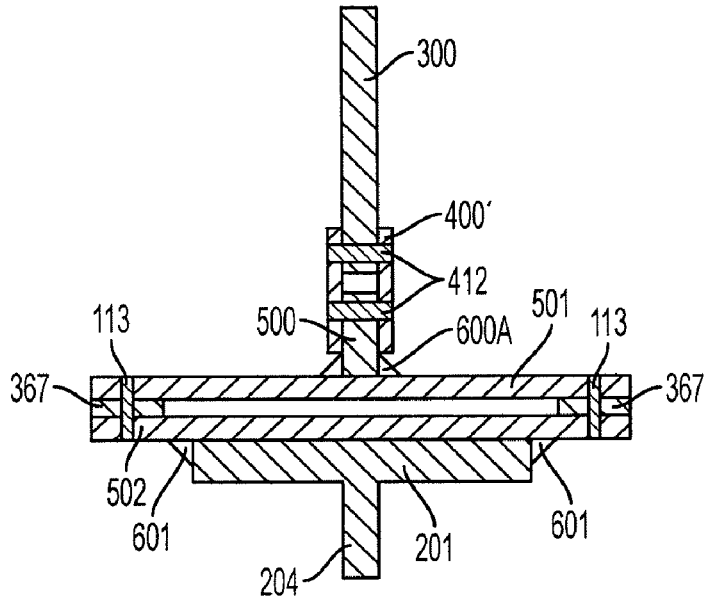
FIG. 15 is a cross-section of a beam, column, and gusset plate connection with a double flex plate and spacer plate welded connection according to embodiments of the invention.

FIGS. 14 and 15 are further embodiments of the present invention. FIGS. 14 and 15 are modifications of FIG. 11. A double flex plate assembly may be used for the connection of the gusset plate 300 to the first beam flange 201. The flex plate 501 is welded to the vertical plate 500 via welds 600A. A second flex plate 502 is arranged on the first beam flange 201. Spacer plates 367 are sandwiched between the flex plate 501 and the second flex plate 502. FIGS. 14 and 15 differ in their ways of connecting the components of the structural framework.

FIG. 14 utilizes bolts to connect the flex plate 501 to the second flex plate 502 to the first beam flange 201. The spacer plates 367 are bolted to both flex plates 501, 502 by bolts 113. The second flex plate 502 may be bolted to the first beam flange 201 by bolts 114.

FIG. 15 utilizes bolt and weld connections. As in FIG. 14, the flex plate 501 is welded to the vertical plate 500 via welds 600A. The flex plate 501 is bolted to the spacer plates 367 by bolts 113. FIG. 15 differs from FIG. 14 in that the second flex plate 502 may be welded to the first beam flange 201 via welds 601. The configurations of FIGS. 14 and 15 may use other connections practiced in the field. The double flex plates connection may provide a flexible beam to column connection so that any deformation in the beam or column may be elastic.

Figure 16:
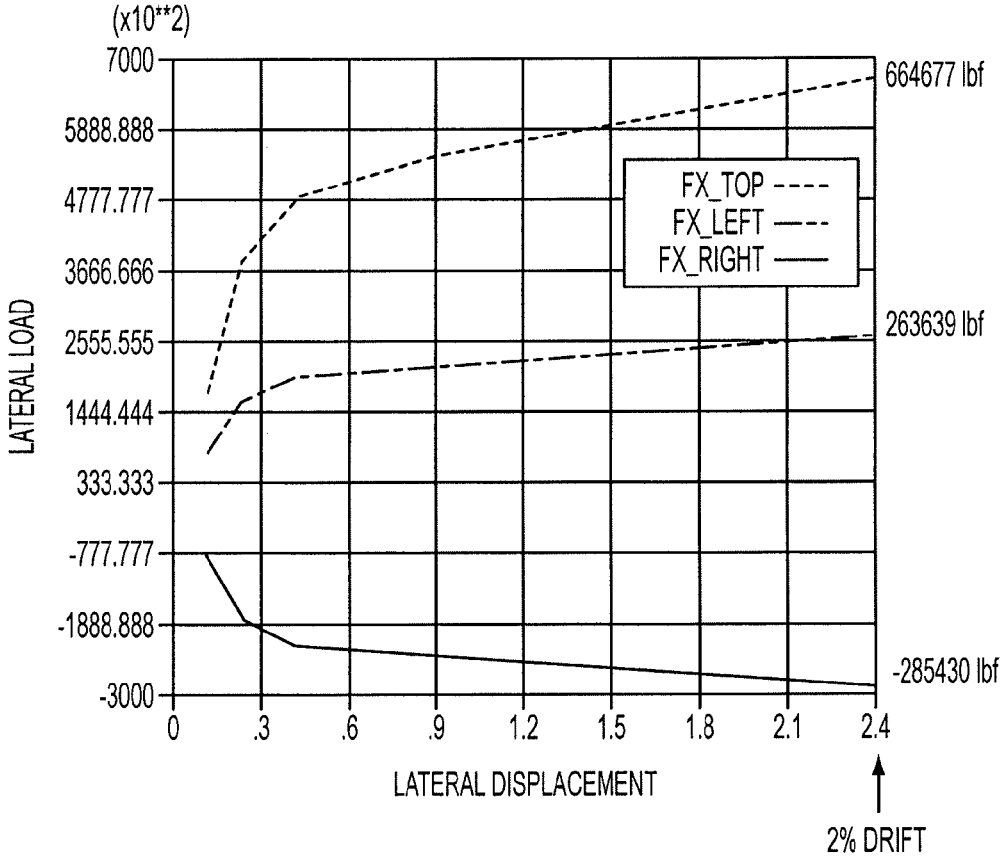
FIG. 16 is a graph showing the distribution of lateral forces between the moment frame components and the frame brace in a single story braced frame as a function of the story drift or displacement according to embodiments of the invention.

FIG. 16 depicts a graph of the projected distribution of the frame brace forces in a structural single story braced frame as a function of lateral displacement of the frame under loads according to the flexible connections of embodiments of the invention. An example of such structural frame is the chevron frame of FIG. 1B. Examples of the loads to be exerted on the structural frame are seismic and wind loading.

The analysis in FIG. 16 depicts the results of a structural framework tested the structural framework according to the embodiment shown in FIG. 13 which shows a flex plate design. The analysis utilized a wide flange or I beam of 21 inches by 93 pounds per foot (W21×93) and a wide flange or I column of 14 inches by 176 pounds per foot (W14×176). The area of the frame brace is 6.33 inches squared (6.33 $in^2$). For a 2% (0.02) drift or displacement of the structural framework, the lateral displacement of the structural frame is calculated as 2.4 inches.

A total lateral force of 664677 pounds was calculated to cause the lateral displacement of 2.4 inches. The frame brace members experience a horizontal force component of 263639 pounds in tension and −285430 pounds in compression. Therefore, the total force resisted by the frame brace members is 549069 pounds (263639 lbs.+285430 lbs.=549069 lbs.). The force of 549069 lbs. represents 82.6% of the total lateral force of 664677 pounds calculated for the 2% drift (549069/664677=0.826). This means that the frame brace members resist 82.6% of the lateral load. The rest of the load is exerted on the beams and the columns (664677−549069=115608 lbs). This represents that merely 17.4% of the total lateral load is resisted by the beams and the columns (115608/664677=0.174).

Typically, in braced frames of the type shown in FIGS. 1A and 1B with a rigid connection such as FIG. 2, only 50% of the lateral load is resisted by the frame brace members. The rest of the 50% of the lateral load is resisted by the beams and columns. With the embodiments of the invention, the frame brace members resist approximately 32.6% more of the lateral load than the frame brace members with conventional rigid connections.

The results of the experiment and graph show that the flex plate design is a flexible semi-rigid connection. It allows the gusset plate and the frame brace members to deform plastically while allowing the beams and the columns to elastically deform under a given load. Such result may allow the columns and beams to maintain their structural integrity and allow for easy replacement of the plastically deformed brace frame members and gusset plates.

What is claimed is:

1. A semi-rigid connection in a structural framework, comprising:

a column having a first flange, a second flange, and a column web;

a beam having a first flange and second flange and a beam web coupled at an angle to the column;

a brace beam coupled diagonally to the column and the beam;

a flex plate having a first side and a second side and a first edge and a second edge;

a gusset plate having a first side and a second side, wherein the first side is coupled to the first column flange and the second side is coupled to the first side of the flex plate;

a first spacer plate having a first side and a second side, wherein the first side is coupled to the second side of the flex plate adjacent to the first edge of the flex plate and the second side is coupled to the first flange of the beam; and a second spacer plate having a first side and a second side, wherein the first side is coupled to the second side of the flex plate adjacent to the second edge of the flex plate and the second side is coupled to the first flange of the beam.

2. The semi-rigid connection according to claim 1, wherein the first beam flange is welded to the first column flange and the beam web is coupled to the first column flange.

3. The semi-rigid connection according to claim 2, further comprising:

a shear plate coupled to the first column flange and coupled to the beam web, wherein the shear plate comprises one or a plurality of horizontally slotted recesses to receive a respective bolt such that the shear plate is bolted to the beam web in a manner to resist only vertical forces between the beam web and the shear plate.

4. The semi-rigid connection according to claim 3, wherein the first spacer plate and the second spacer plate each include one or a plurality of spacer recesses and the flex plate comprises one or a plurality of plate recesses, and wherein the flex plate is bolted through the plate recesses and the spacer recesses to the first beam flange.

5. The semi-rigid connection according to claim 4, wherein the flex plate is welded to the first side of the gusset plate and the second side of the gusset plate is welded to the first column flange.

6. The semi-rigid connection according to claim 2, further comprising a slot in the beam web adjacent and parallel to the first beam flange; and a slot in the column web adjacent and parallel to the first column flange.

7. The semi-rigid connection according to claim 3, wherein the horizontally slotted recesses comprise a two to one dimension in a longitudinal direction.

* * * * *